United States Patent [19]

Pätzold et al.

[11] Patent Number: 5,006,455

[45] Date of Patent: Apr. 9, 1991

[54] GRADATION-VARIABLE BLACK-AND-WHITE PAPER

[75] Inventors: Walter Pätzold, Leverkusen; Helmut Kampfer, Cologne, both of Fed. Rep. of Germany

[73] Assignee: Agfa-Gevaert Aktiengesellschaft, Leverkusen, Fed. Rep. of Germany

[21] Appl. No.: 269,993

[22] Filed: Nov. 10, 1988

[30] Foreign Application Priority Data

Nov. 24, 1987 [DE] Fed. Rep. of Germany ..... 3739766

[51] Int. Cl.[5] ..... G03C 1/035; G03C 1/34

[52] U.S. Cl. ..... 430/571; 430/611; 430/613

[58] Field of Search ..... 430/571, 611, 613

[56] References Cited

U.S. PATENT DOCUMENTS

| | | | |
|---|---|---|---|
| 2,403,927 | 7/1946 | Kendall et al. | 430/611 |
| 3,628,960 | 12/1971 | Philippaerts et al. | 430/571 |

FOREIGN PATENT DOCUMENTS

| | | | |
|---|---|---|---|
| 539568 | 4/1957 | Canada | 430/571 |
| 1151731 | 7/1963 | Fed. Rep. of Germany | 430/613 |
| 494088 | 10/1938 | United Kingdom | 430/571 |
| 924350 | 4/1963 | United Kingdom | 430/611 |
| 928840 | 6/1963 | United Kingdom | 430/611 |
| 1298302 | 11/1972 | United Kingdom | 430/571 |

OTHER PUBLICATIONS

R D 24236, Jun. 1984.

*Primary Examiner*—Charles L. Bowers, Jr.
*Assistant Examiner*—Lee C. Wright
*Attorney, Agent, or Firm*—Connolly & Hutz

[57] ABSTRACT

A gradation-variable BW paper comprising only one silver halide emulsion layer, in which re-sensitization is avoided, is obtained with a mixture of at least two photosensitive silver halide emulsions, of which one has its absorption maximum in the range from 480 to 580 while the other has its absorption maximum below 480 nm, providing the emulsion which has its absorption maximum below 480 nm contains a compound corresponding to the following formula in which X represents the remaining members of an optionally benzo- or naphtho-condensed heterocycle optionally containing further substituents.

5 Claims, No Drawings

GRADATION-VARIABLE BLACK-AND-WHITE PAPER

This invention relates to a gradation-variable black-and-white paper containing at least two silver halide emulsions which are mixed before casting and which are sensitive to different spectral regions, a special stabilizer being added to at least one of the emulsions. The term BW as used hereinafter refers to and is an abbreviation of black-and-white- material.

Gradation-variable photosensitive silver halide materials contain emulsions which are sensitive to various spectral regions. Harder or softer gradation is obtained according to the composition of the copying light. The emulsions are normally mixed before casting so that only one layer has to be cast. This involves the danger of resensitization whereby sensitizing dye is desorbed from the silver halide grains of one emulsion and is adsorbed onto grains of a non-sensitized, blue-sensitive emulsion. This is undesirable because such differentiated exposure through changing of the copying light no longer leads to the desired result. Under adverse conditions, the process of resenitization is not confined to the casting solution and can also occur in the finished material, for example under the effect of moisture, heat or both.

To avoid resensitization, elaborate precautions have to be taken, for example in the storage of the finished material or by shortening the standing time of the prepared casting solution. Since these negative effects cannot always be eliminated by the producer, there has been no shortage of attempts to develop methods for avoiding resensitization. Thus, it has been proposed to remove surplus sensitizing dye (DL-PS 7210), not to exceed certain critical temperatures during the mixing and casting of the casting solution (U.S. Pat. No. 2,367,508), to avoid prolonged standing times of the casting solutions (GB-PS 540,451, DE-OS 24 26 676), to add metal compounds to the casting solutions to prevent the diffusion of the sensitizing dyes (U.S. Pat. No. 2,336,260) or not to mix the differently sensitized or non-sensitized emulsions, but instead to cast them separately over one another (GB-PS 541,515 and FR-PS 2,251,837).

None of these measures has satisfactorily solved the problem either because it was not possible to rule out sensitization during the storage of the finished material or because the production of the material was made much more expensive by the multiple casting.

Accordingly, the object of the present invention is to provide a gradation-variable BW paper in which these disadvantages do not arise.

It has now been found that this object can be achieved by mixing at least two photosensitive silver halide emulsions, of which one has its absorption maximum in the range from 480 to 580 nm and preferably in the range from 500 to 550 nm while the other has its absorption maximum below 480 nm, to form a casting solution and applying the resulting casting solution to the support, the emulsion which has its absorption maximum below 480 nm containing a compound corresponding to the following formula

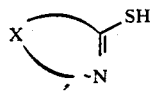

in which

X represents the remaining members of an optionally benzo- or naphtho-condensed heterocycle optionally containing further substituents.

The heterocyclic rings in question are 5-membered and 6-membered rings which may contain 1 to 3 heteroatoms of the O, S, Se and N type and which may be benzo- or naphtho-condensed. Examples of such heterocyclic rings are oxazole, thiazole, selenazole, imidazole, tetrazole, triazoles, pyrimidine and benzo- and naphtho-condensed derivatives thereof which may be substituted by sulfo, carboxy, halogen, $C_1$–$C_4$ alkyl, aryl, more especially phenyl, sulfophenyl, carboxyphenyl, $C_1$–$C_4$ alkylcarbonylamino, C–$C_4$ alkylaminosulfonyl or arylaminosulfonyl, more especially phenylamino sulfonyl and chlorophenylaminosulfonyl.

Preferred compounds correspond to the following formula

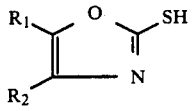

in which $R_1$ and $R_2$ are the remaining members of a benzo or naphtho group substituted by at least one solubilizing group and optionally containing further substituents.

$R_1$ and $R_2$ are preferably the remaining members of a benzo- or naphtho group which is substituted by one or two sulfo groups and which may be further substituted by $C_1$–$C_4$ alkyl or halogen. The sulfonic acid groups and the mercapto groups may also be present in the form of their salts, more especially their alkali or ammonium salts. Suitable examples are:

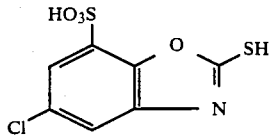

I

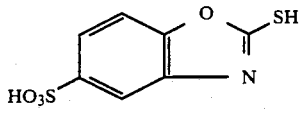

II

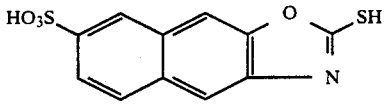

III

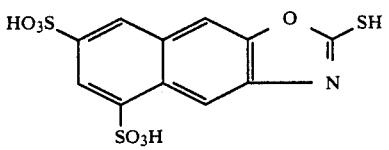

IV

-continued

V

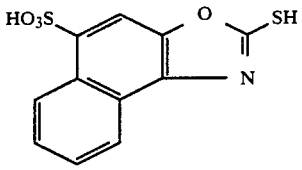

VI

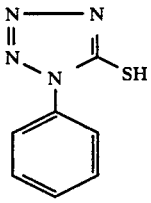

VII

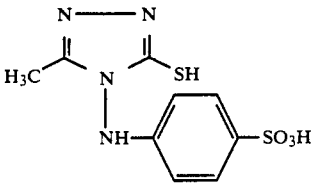

VIII

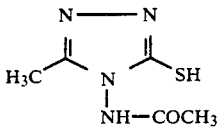

IX

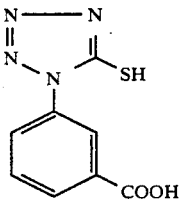

X

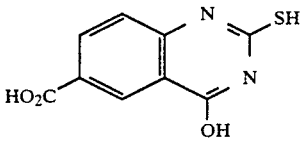

XI

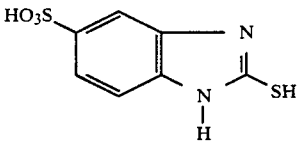

-continued

XII

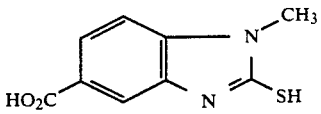

XIII

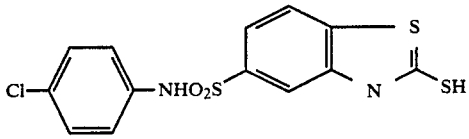

The emulsion which has its absorption maximum between 480 and 580 nm is prepared by standard spectral sensitization with green-sensitive sensitizers.

The emulsion which has its absorption maximum below 480 nm is either a non-sensitized silver halide emulsion, of which the natural sensitivity lies in the range indicated, absorptions below 360 nm being of no interest because the absorption of gelatin is situated from here towards shorter wavelengths, or an emulsion containing a blue-sensitive sensitizer.

The green-sensitive and blue-sensitive partial emulsions may be mixed in a ratio by weight of 1.5:1 to 1:10 and preferably in a ratio by weight of 1:1 to 1:3, based on their silver content.

The emulsions are preferably silver chloride bromide emulsions containing 20 to 80 mol-% chloride, 20 to 80 mol-% bromide and 0 to 5 mol-% iodide. The average grain size is, in particular, from 0.2 to 0.6 μm, the silver halide grains being cubic to octahedral.

Photographic emulsions suitable for the material according to the invention may be prepared by "tipping" (=rapid uncontrolled mixing of the reaction solutions), single-jet precipitation, double-jet precipitation or conversion processes.

The average grain size may be between 0.2 and 0.6 μm and is preferably between 0.4 and 0.5 μm.

The silver halide crystals may be doped with $Rh^{3+}$, $Ir^{4+}$, $Cd^{2+}$, $Zn^{2+}$, $Pb^{2+}$.

The emulsion may be freed from salts in the usual way (dialysis, flocculation and redepersion, ultrafiltration).

The emulsion may be chemically sensitized by labile sulfur compounds (for example thiosulfate, diacetyl thiourea), by gold-sulfur ripening or by reduction ripening. Chemical sensitization may be accompanied by addition of Ir, Rh, Pb, Cd, Hg, Au.

Sensitivity in the 480–580 range may be produced with cyanine and merocyanine dyes of the type described in the book by F. M. Hamer entitled "The Cyanine Dyes and Related Compounds", 1964, John Wiley & Sons. Suitable dyes are, for example, dyes corresponding to the following formulae:

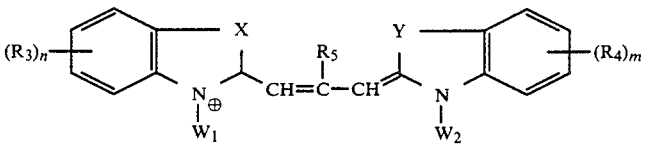

-continued

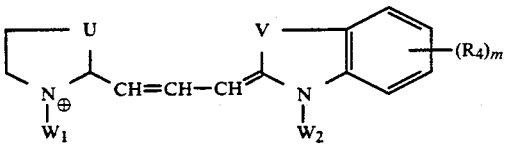

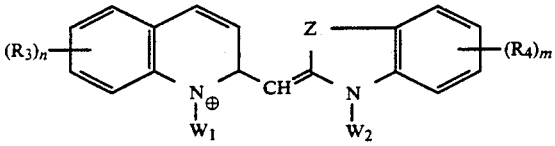

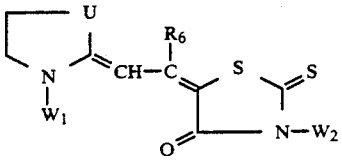

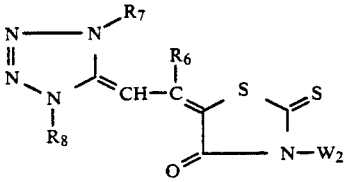

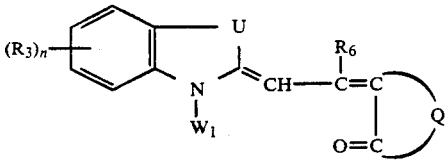

X, Y=O, N-$R_7$,
U, V=$CH_2$, $C(R_7)_2$, O, N-$R_7$, S
Z=S, Se, —CH=CH—,
$R_3$, $R_4$=$CH_3$, $C_2H_5$, $OCH_3$, halogen, CN, $SO_2R_5$, carbalkoxy, sulfonamido and—where n or m=2—complete the fused benzene ring.
$R_5$, $R_6$=H, $CH_3$, $C_2H_5$,
$R_7$, $R_8$=$CH_3$, $C_2H_5$,
n, m=0–2
$W_1$, $W_2$=$C_1$–$C_4$ alkyl, optionally substituted by hydroxy, carboxy or sulfo and
Q represents the ring members required to complete a thiocyanine, thiohydantoin, thiooxazolidone or thiobarbituric acid ring.

The following dyes, for example, are particularly suitable:

SE1

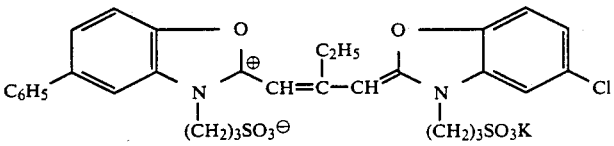

SE2

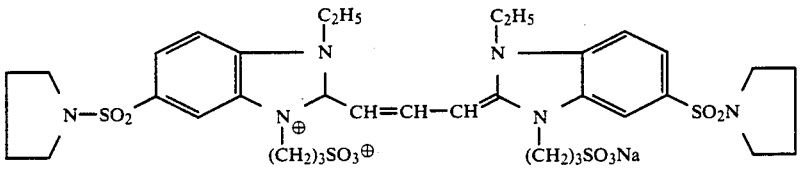

SE3

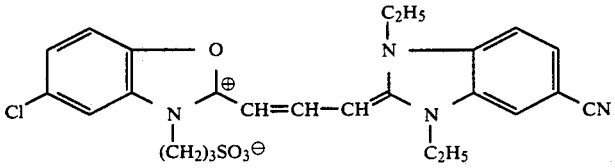

-continued
SE4
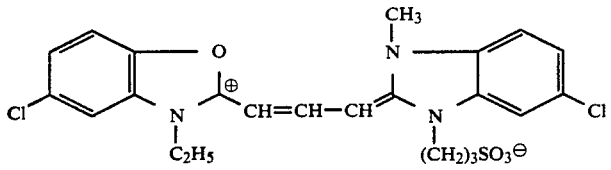
SE5
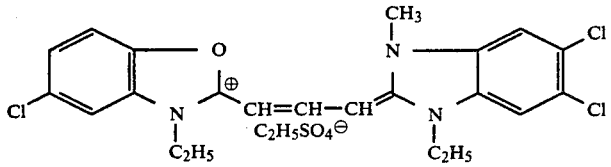
SE6
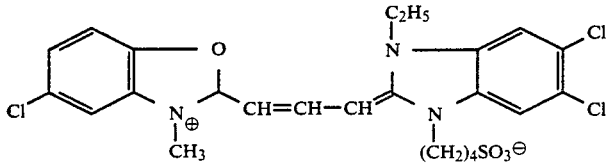
SE7
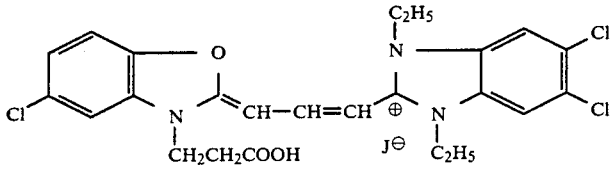
SE8
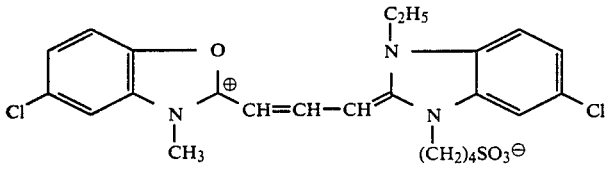
SE9
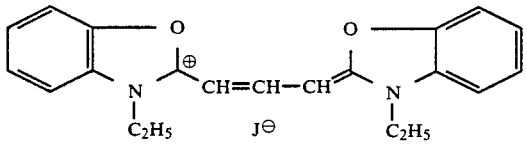
SE10
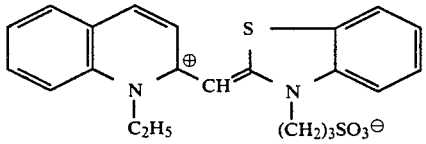
SE11
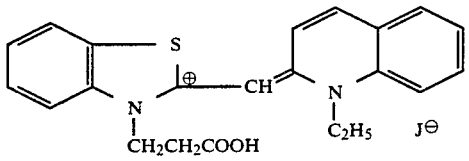
SE-12
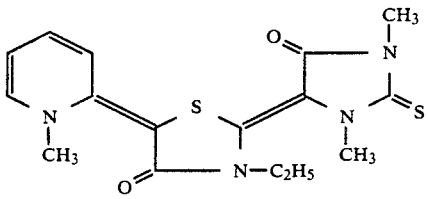

-continued

SE13

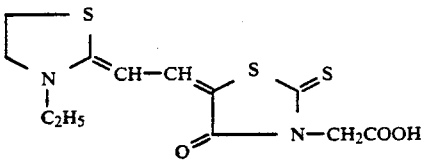

SE14

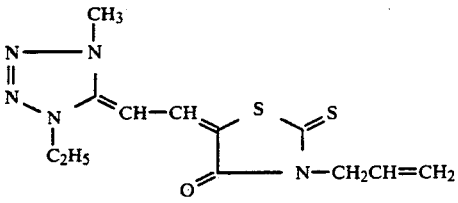

SE15

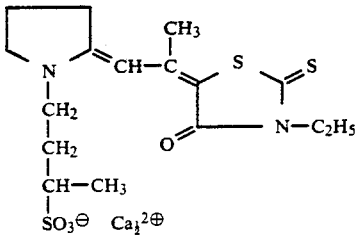

SE16

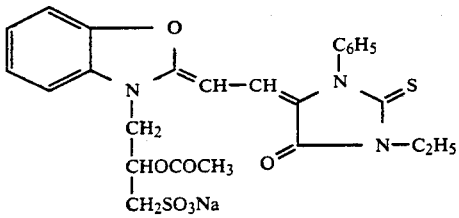

SE17

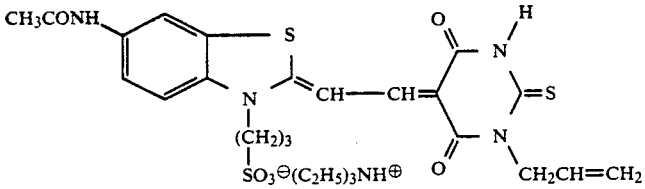

SE18

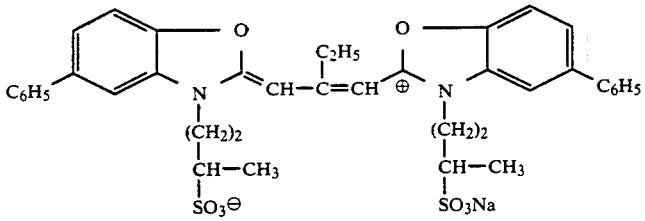

Although the second part of the emulsion which has a spectral sensitivity below 480 nm may be used in accordance with the invention even without the addition of a spectral sensitizer, it is nevertheless of advantage to increase the sensitivity of this part of the emulsion at wavelengths <480 nm by addition of a suitable sensitizing dye. Dyes corresponding to the following formulae for example are suitable for this purpose:

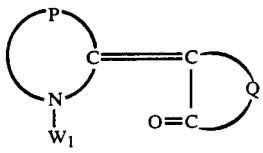

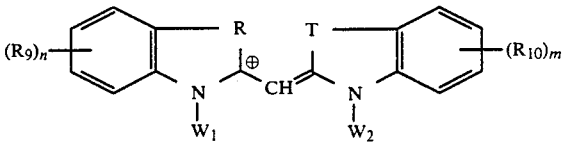

in which

P represents the members required to complete an optionally benzo-fused heterocyclic 5-membered ring,

R, T=O, S, N-$R_7$, $R_9$, $R_{10}$=$CH_3$, $CH_3O$, halogen and—where R or T=O, phenyl and Q, $W_1$, $W_2$, n and m are as defined above.

The following dyes for example are particularly suitable:

BS1

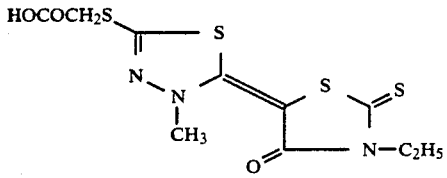

BS2

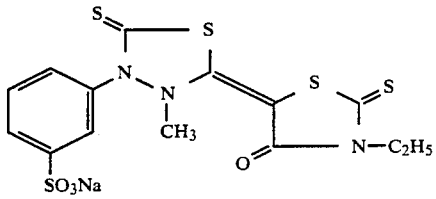

BS3

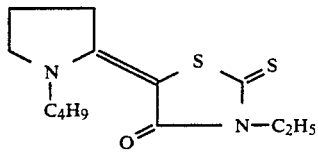

BS4

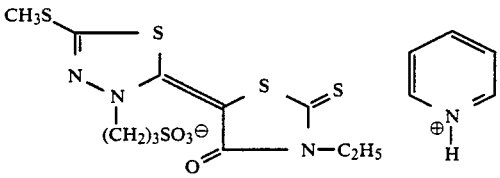

BS5

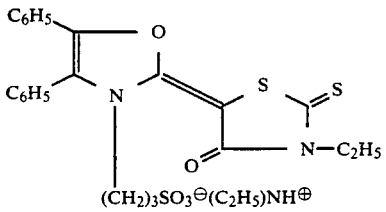

BS6

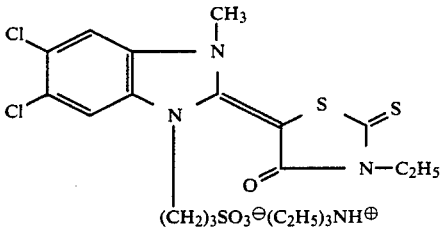

BS7

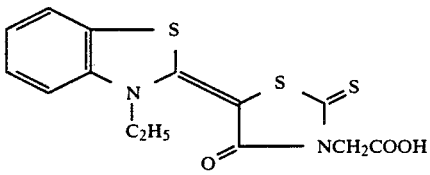

-continued

BS8

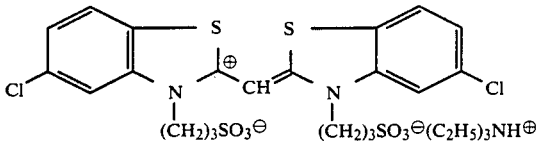

BS9

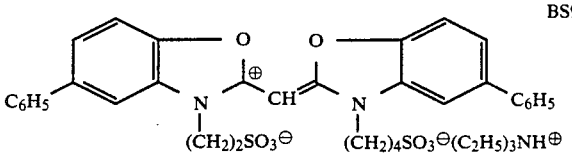

BS10

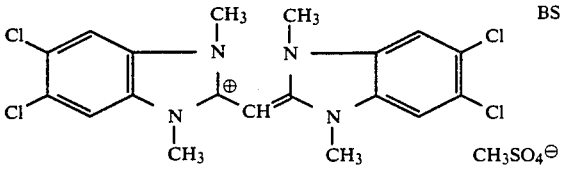

In addition to the silver halide, an essential constituent of the at least one photosensitive layer is the binder. Gelatin is preferably used as the binder, although it may be completely or partly replaced by other synthetic, semisynthetic or even naturally occurring polymers. Synthetic gelatin substitutes are, for example, polyvinyl alcohol, poly-N-vinylpyrrolidone, polyacrylamides, polyacrylic acid and derivatives thereof, more especially copolymers. Naturally occurring gelatin substitutes are, for example, other proteins, such as albumin or casein, cellulose, sugars, starch or alginates. Semisynthetic gelatin substitutes are, generally, modified natural products. Cellulose derivatives, such as hydroxyalkyl cellulose, carboxymethyl cellulose and phthalyl cellulose, and also gelatin derivatives which have been obtained by reaction with alkylating or acylating agents or by grafting on of polymerizable monomers are examples of semisynthetic gelatin substitutes.

The binders should contain an adequate number of functional groups so that sufficiently resistive layers can be produced by reaction with suitable hardeners. Such functional groups are, in particular, amino groups, but also carboxyl groups, hydroxyl groups and active methylene groups.

The gelatin preferably used may be obtained by acidic or alkaline digestion. The production of such gelatins is described, for example, in "The Science and Technology of Gelatine" A. G. Ward and A Courts, Academic Press 1977, pages 295 et seq. The particular gelatin used should have a minimal content of photographically active impurities (inert gelatin). Gelatins of high viscosity and low swelling are particularly advantageous.

The silver halide present as photosensitive component in the photographic material may be in the form of predominantly compact crystals which may have, for example, regular cubic or octahedral forms or transitional forms. However, the silver halide may also be present in the form of platelet-like crystals of which the average diameter-to-thickness ratio is preferably greater than 5:1, the diameter of a grain being defined as the diameter of a circle having an area corresponding to the projected area of the grain.

The silver halide grains may also have a multilayer grain structure, in the most simple case with an inner and an outer grain zone (core/shell) the halide composition and/or other modifications, such as for example doping of the individual grain zones, being different. The grain size distribution may be both homodisperse and also heterodisperse. A homodisperse grain size distribution means that 95% of the grains deviate from the average grain size by no more than ±30%. In addition to the silver halide, the emulsions may also contain organic silver salts, for example silver benztriazolate or silver behenate.

Two or more types of silver halide emulsions prepared separately may be used in admixture.

The photographic emulsions may be prepared from soluble silver salts and soluble halides by various methods (cf. for example P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The focal Press, London (1966).

Precipitation of the silver halide preferably occurs in the presence of the binder, for example the gelatin, and may be carried out in an acidic, neutral or alkaline pH range, preferably in the additional presence of silver halide complexing agents, including for example ammonia, thioether, imidazole, ammonium thiocyanate or excess halide. The water-soluble silver salts and the halides may be combined either successively by the single-jet process or simultaneously by the double-jet process or by a combination of these two processes. Dosing at increasing inflow rates is preferred, although the "critical" feed rate, at which new seeds are still not quite formed, should not be exceeded. The pAg range may vary within wide limits during the precipitation process. The so-called pAg-controlled process is preferably used. In this process, a certain pAg value is kept constant or the pAg value passes through a certain pAg profile during the precipitation process. However, in addition to the preferred precipitation where halide is present in excess, so-called inverse precipitation is also possible where silver ions are present in excess. The silver halide crystals can grow not only through precipitation, but also by physical ripending (Ostwald ripening) in the presence of excess halide and/or silver halide complexing agent. The emulsion grains may even be predominantly grown by Ostwald ripening, in which case a fine-grained, so-called Lippmann emulsion is preferably mixed with a more difficultly soluble emulsion and dissolved in and allowed to crystallize thereon.

In addition to the mercapto-substituted heterocycles to be used in accordance with the invention, the photographic emulsions may contain compounds which prevent fogging or which stabilize the photographic function during production, storage or photographic processing, more especially in the layer which is sensitive in the 480 to 580 nm range.

Azaindenes, preferably tetra- and penta-azaindenes, especially those substituted by hydroxyl or amino groups, are particularly suitable. Compounds such as these are described, for example, by Birr in Z. Wiss. Phot. 47 (1952), pages 2–58. Other suitable antifogging agents are salts of metals, such as mercury or cadmium, aromatic sulfonic or sulfinic acids, such as benzenesulfinic acid, or nitrogen-containing heterocycles, such as nitrobenzimidazole, nitroindazole, (substituted) benztriazoles or benzthiazolium salts. Heterocycles containing mercapto groups, for example mercaptobenzthiazoles, mercaptobenzimidazoles, mercaptotetrazoles, mercaptothiadiazoles, mercaptopyrimidines, are particularly suitable; these mercaptoazoles may even contain a water-solubilizing group, for example a carboxyl group or sulfo group. Other suitable compounds are described in Research Disclosure no. 17643 (1978), Section VI.

The stabilizers may be added to the silver halide emulsions before, during or after their ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surfactants for various purposes, such as coating aids, for preventing electrical charging, for improving antiblocking properties, for emulsifying the dispersion, for preventing adhesion and for improving the photographic characteristics (for example development acceleration, high contrast, sensitization, etc.).

The emulsion may be chemically sensitized by labile sulfur compounds (for example thiosulfate, diacetyl thiourea), by gold-sulfur ripening or by reduction ripening. Chemical sensitization may be accompanied by addition of Ir, Rh, Pb, Cd, Hg, Au and also by addition of optical sensitizers or stabilizers.

In addition, the photographic material may contain UV absorbers, white toners, spacers, formalin acceptors and others.

UV absorbers on the one hand should protect the image dyes against bleaching out by UV-rich daylight and, on the other hand, should as filter dyes absorb the UV light in daylight during exposure, thus improving the color reproduction of a film. Compounds of different structure are normally used for these two functions. Examples include aryl-substituted benzotriazole compounds (U.S. Pat. No. 3,533,794), 4-thiazolidone compounds (U.S. Pat. Nos. 3,314,794 and 3,352,681), benzophenone compounds (JP-A 2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

UV-absorbing couplers (such as cyan couplers of the α-naphthol type) and UV-absorbing polymers may also be used. These UV absorbers may be fixed in a special layer by mordanting.

Suitable white toners are described, for example, in Research Disclosure 17 643, December 1978, Chapter V, pages 22 et seq.

The average particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The binders of the material according to the invention, particularly where gelatin is used as binder, are hardened with suitable hardeners, for example with hardeners of the epoxide type, the ethylene imine type, the acryloyl type or the vinylsulfone type. Hardeners of the diazine, triazine or 1,2-dihydroquinoline series are also suitable.

The binders of the material according to the invention are preferably hardened with instant hardeners.

Instant hardeners are understood to be compounds which crosslink suitable binders in such a way that, immediately after casting and, at the latest, 24 hours after casting and preferably 8 hours after casting at the lastest, hardening has progressed to such an extent that there is no further change in the sensitometric data or in the swelling of the layers through the crosslinking reaction. By swelling is meant the difference between wet layer thickness and dry layer thickness in the aqueous processing of the film (Photogr. Sci. Eng. 8 (1964), 275; Photogr. Sci. Eng. (1972), 449).

These hardeners which react very quickly with gelatin are, for example, carbamoyl pyridinium salts which are capable of reacting with free carboxyl groups of the gelatin so that the free carboxyl groups react with free amino groups of the gelatin with formation of peptide bonds and crosslinking of the gelatin.

Suitable instant hardeners are, for example, compounds corresponding to the following general formulae

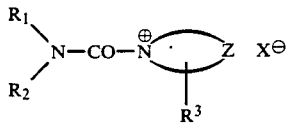

(a)

in which $R_1$ represents alkyl, aryl or aralkyl, $R_2$ has the same meaning as $R_1$ or represents alkylene, arylene, aralkylene or alkaralkylene, the second bond being attached to a group of the formula

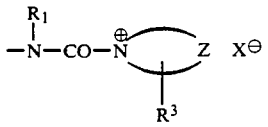

or $R_1$ and $R_2$ together represent the atoms required to complete an optionally substituted heterocyclic ring, for example a piperidine, piperazine or morpholine ring, which may be substituted, for example, by $C_1$–$C_3$ alkyl or halogen, $R_3$ represents hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ is hydrogen, $C_1$–$C_4$ alkyl or $NR_6R_7$, $R_8$=—$COR_{10}$, $R_{10}$=$NR_{11}R_{12}$, $R_{11}$=$C_1$–$C_4$ alkyl or aryl, particularly phenyl, $R_{12}$=hydrogen, $C_1$–$C_4$ alkyl or aryl, particularly phenyl, $R_{13}$=hydrogen, $C_1$–$C_4$ alkyl or aryl, particularly phenyl, $R_{16}$=hydrogen, $C_1$–$C_4$ alkyl, $COR_{18}$ or $CONHR_{19}$, m=a number of 1 to 3, n=a number of 0 to 3, p=a number of 2 to 3 and Y=0 or $NR_{17}$ or $R_{13}$ and $R_{14}$ together represent the atoms required to complete an optionally substituted heterocyclic ring, for example a piperidine, piperazine or morpholine ring, which may optionally be substituted, for example, by $C_1$–$C_3$ alkyl or halogen, Z represents the carbon atoms required to complete a 5-or 6-membered aromatic heterocyclic ring, optionally with a fused benzene ring, and $X^{\theta}$ is an anion which is redundant where an anionic group is already attached to the remainder of the molecule;

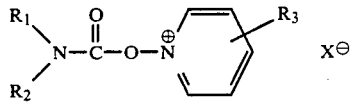

(b)

in which $R_1$, $R_2$, $R_3$ and $X^{\theta}$ are as defined for formula (a).

The materials according to the invention are processed in the usual way by recommended processes.

EXAMPLE 1 (Comparison Example)

An AgClBrI emulsion prepared by partial conversion containing 40% AgCl, 59.5% AgBr and 0.5% AgI and doped with $4\times10^{8}$ $^{-8}$ mol $NaRhCl_4$/mol $AgNO_3$ and $2\times10^{-5}$ mol $Na_2IrCl_6$/mol $AgNO_3$, mean grain diameter 0.42 μm, is freed from salts in known manner and, after the addition of 20 μm thiosulfate/mol $AgNO_3$, is ripened under sensitometric control to an optimal sensitivity/fog ratio. The emulsion contains 100 g $AgNO_3$ in 1 kg emulsion.

Green-sensitized partial emulsion:

300 g of the emulsion are optically sensitized for the green spectral region by addition of 37 mg of sensitizer SE 18 and stabilized by the addition of 30 mg 5-hydroxy-7-methyl-1,3,8-trazaindolizine per kg emulsion.

Unsensitized partial emulsion:

700 g of the emulsion are stabilized by the addition of 30 mg 5-hydroxy-7-methyl-1,3,8-triazaindolizine. The partial emulsions are mixed; one part is cast onto an opaque support with addition of a gelatin hardener (just 1A). Another part of the mixture is kept at 40° C. for 4 hours and then cast with addition of a gelatin hardener (test 1B).

EXAMPLE 2 (Invention)

The emulsion was prepared and sensitized for the 480 to 580 nm spectral region in accordance with Example 1.

Unsensitized partial emulsion:

This part of the emulsion is stabilized as in Example 1 with 30 mg 5-hydroxy-7-methyl-1,3,8-triazaindolizine and, in addition, with 200 mg stabilizer III per kg emulsion.

The partial emulsions are mixed and cast as in Example 1 (tests 2A and 2B).

EXAMPLE 3 (Invention)

The emulsion is prepared and sensitized for the 480 to 580 nm spectral region in the same way as in Example 1, except that 250 g of an emulsion of 60 mol-% AgCl, 39.5 mol-% AgBr and 0.5 mol-% AgI are used.

Blue-sensitized partial emulsion:

20 mg of sensitizer BS6 and 30 mg 5-hydroxy-7-methyl-1,3,8-triazaindolizine are added to 250 g of the unsensitized emulsion.

Unsensitized partial emulsion:

30 mg 5-hydroxy-7-methyl-1,3,8-triazaindolizine and 160 mg of stabilizer I are added to 500 g of the unsensitized emulsion.

The three partial emulsions are mixed and cast as in Example . . . (tests 3A and 3B).

Photographic evaluation of Examples 1 to 3

A sample of the material is exposed behind a yellow filter and a step wedge. A second sample is exposed behind a magenta filter and a step wedge. After development with a standard developer for BW paper (for example Agfa 100), the density of the steps is measured. From the density curve, log ER is determined in accordance with ANSI Standard PH 2.2-1966 (Table 1). (Exposure through yellow filters produces an image of low contrast=high log ER while exposure through magenta filters produces an image of high contrast=-low log ER).

Artificial ageing

Part of the material (1A, 2A, 3A) is subjected to artificial ageing by storage for 2 days in a humid atmosphere of 45° C./65% relative humidity (1C, 2C, 3C).

Photographic evaluation is then carried out as described above (Table 2).

TABLE 1

| Log ER | Example 1 | | Example 2 | | Example 3 | |
|---|---|---|---|---|---|---|
| Yellow filter: | 1A | 1.20 | 2A | 1.25 | 3A | 1.38 |
| | 1B | 0.95 | 2B | 1.20 | 3B | 1.35 |
| Magenta filter: | 1A | 0.60 | 2A | 0.58 | 3A | 0.56 |
| | 1B | 0.75 | 2B | 0.62 | 3B | 0.60 |

TABLE 2

| Log ER | Example 1 | | Example 2 | | Example 3 | |
|---|---|---|---|---|---|---|
| Yellow filter: | 1A | 1.20 | 2A | 1.25 | 3A | 1.38 |
| | 1C | 1.05 | 2C | 1.20 | 3C | 1.34 |
| Magenta filter: | 1A | 0.60 | 2A | 0.58 | 3A | 0.56 |
| | 1C | 0.70 | 2C | 0.61 | 3C | 0.59 |

EXAMPLE 4

The following emulsions having the indicated composition and grain size are prepared and chemically ripened as in Example 1. Each emulsion is divided into two equal parts, of which the first partial emulsion is sensitized with the spectral sensitizer in the 480 to 580 nm range, while the stabilizer is added in accordance with the invention to the second partial emulsion. The two partial emulsions are then mixed and cast as usual onto a PE paper support (silver applied: 1.4 g/m$^2$). These samples according to the are called samples A.

For comparison, another two samples B and C are prepared. The samples B differ from A through the omission of the stabilizer in the second partial emulsion. The samples C contain the spectral sensitizer uniformly distributed over all the emulsion crystals in the same concentration per m$^2$ as in samples A and B.

The samples are then subjected to sensitometric evaluation behind a yellow filter and a magenta filter. After development in an Agfa Neutol paper developer, log ER is determined.

The results are shown in Tables 3 to 5. In Tables 3 to 5, column 1 shows the code of the sample (A, B or C), column 2 shows the sensitizer used, column 3 shows the quantity of sensitizer in μmol per mol silver of the first partial emulsion and of the entire emulsion in the case of samples C column 4 shows the stabilizer used column 5 shows the quantity of stabilizer in mg per mol silver of the second partial emulsion column 6 shows log ER behind the Yw filter column 7 shows log ER behind the Mg filter column 8 shows the spectral sensitization maximum in nm

TABLE 3

| | Emulsion: 85% $Br^{\ominus}$, 15% $Cl^{\ominus}$, grain size: 0.34μ | | | | | | |
|---|---|---|---|---|---|---|---|
| 1 | 2 | 3 | 4 | 5 | 6 | 7 | 8 |
| A | SE5 | 200 | VIII | 300 | 1.12 | 0.67 | 540 |
| B | SE5 | 200 | — | — | 0.75 | 0.68 | 540 |
| C | SE5 | 100 | — | — | 0.64 | 0.66 | 540 |
| A | SE3 | 200 | IX | 300 | 1.15 | 0.71 | 520 |
| B | SE3 | 200 | — | — | 0.85 | 0.75 | 520 |
| C | SE3 | 100 | — | — | 0.71 | 0.73 | 520 |
| A | SE16 | 200 | I | 300 | 1.12 | 0.69 | 525 |
| B | SE16 | 200 | — | — | 0.75 | 0.74 | 525 |
| C | SE16 | 100 | — | — | 0.73 | 0.72 | 525 |
| A | SE17 | 200 | III | 300 | 1.28 | 0.79 | 545 |
| B | SE17 | 200 | — | — | 0.78 | 0.72 | 545 |
| C | SE17 | 100 | — | — | 0.65 | 0.70 | 545 |
| A | SE1 | 50 | III | 400 | 1.13 | 0.68 | 545 |
| B | SE1 | 50 | — | — | 0.86 | 0.74 | 545 |
| C | SE1 | 25 | — | — | 0.72 | 0.64 | 545 |
| A | SE18 | 50 | XII | 400 | 1.16 | 0.67 | 545 |
| B | SE18 | 50 | — | — | 0.78 | 0.72 | 545 |
| C | SE18 | 25 | — | — | 0.74 | 0.73 | 545 |
| A | SE18 | 50 | XII | 200 | 1.22 | 0.75 | 545 |
| A | SE1 | 50 | III | 200 | 1.17 | 0.72 | 545 |

TABLE 4

| | Emulsion: 85% $Br^{\ominus}$, 15% $Cl^{\ominus}$, grain size: 0.34μ | | | | | | |
|---|---|---|---|---|---|---|---|
| 1 | 2 | 3 | 4 | 5 | 6 | 7 | 8 |
| A | SE12 | 50 | III | 300 | 1.05 | 0.75 | 535 |
| B | SE12 | 50 | — | — | 0.70 | 0.79 | 535 |
| C | SE12 | 25 | — | — | 0.69 | 0.78 | 535 |
| A | SE13 | 50 | XII | 300 | 0.98 | 0.76 | 530 |
| B | SE13 | 50 | — | — | 0.58 | 0.69 | 530 |
| C | SE13 | 25 | — | — | 0.62 | 0.67 | 530 |
| A | SE14 | 50 | XIII | 300 | 1.10 | 0.75 | 515 |
| B | SE14 | 50 | — | — | 0.71 | 0.71 | 515 |
| C | SE14 | 25 | — | — | 0.62 | 0.72 | 515 |
| A | SE15 | 50 | III | 300 | 0.99 | 0.75 | 530 |
| B | SE15 | 50 | — | — | 0.61 | 0.72 | 530 |
| C | SE15 | 25 | — | — | 0.63 | 0.73 | 530 |
| A | SE8 | 200 | XI | 150 | 1.19 | 0.70 | 530 |
| B | SE8 | 200 | — | — | 0.89 | 0.69 | 530 |
| C | SE8 | 100 | — | — | 0.78 | 0.67 | 530 |
| A | SE4 | 200 | XIII | 150 | 1.05 | 0.68 | 520 |
| B | SE4 | 200 | — | — | 0.72 | 0.65 | 520 |
| C | SE4 | 100 | — | — | 0.70 | 0.65 | 520 |
| A | SE6 | 200 | XI | 200 | 1.36 | 0.65 | 545 |
| B | SE6 | 200 | — | — | 0.90 | 0.68 | 545 |
| C | SE6 | 100 | — | — | 0.85 | 0.67 | 545 |

TABLE 5

| | Emulsion: 60% $Br^{\ominus}$, 40% $Cl^{\ominus}$, grain size: 0.42μ | | | | | | |
|---|---|---|---|---|---|---|---|
| 1 | 2 | 3 | 4 | 5 | 6 | 7 | 8 |
| A | SE10 | 200 | XIII | 300 | 1.12 | 0.62 | 515 |
| B | SE10 | 200 | — | — | 0.91 | 0.64 | 515 |
| C | SE10 | 100 | — | — | 0.70 | 0.65 | 515 |
| A | SE9 | 150 | VII | 300 | 0.95 | 0.71 | 510 |
| B | SE9 | 150 | — | — | 0.83 | 0.70 | 510 |
| C | SE9 | 75 | — | — | 0.80 | 0.71 | 510 |
| A | SE2 | 200 | VI | 150 | 1.19 | 0.66 | 550 |

TABLE 5-continued

| | Emulsion: 60% $Br^{\ominus}$, 40% $Cl^{\ominus}$, grain size: 0.42μ | | | | | | |
|---|---|---|---|---|---|---|---|
| 1 | 2 | 3 | 4 | 5 | 6 | 7 | 8 |
| B | SE2 | 200 | — | — | 0.82 | 0.66 | 550 |
| C | SE2 | 100 | — | — | 0.73 | 0.62 | 550 |
| A | SE7 | 200 | II | 150 | 1.05 | 0.69 | 525 |
| B | SE7 | 200 | — | — | 0.85 | 0.73 | 525 |
| C | SE7 | 100 | — | — | 0.80 | 0.68 | 525 |
| A | SE2 | 50 | IX | 200 | 1.13 | 0.75 | 550 |
| B | SE2 | 50 | — | — | 0.87 | 0.73 | 550 |
| C | SE2 | 25 | — | — | 0.81 | 0.74 | 550 |
| A | SE1 | 100 | III | 200 | 1.16 | 0.71 | 550 |
| B | SE1 | 100 | — | — | 0.95 | 0.68 | 550 |
| C | SE1 | 50 | — | — | 0.75 | 0.63 | 550 |
| A | SE18 | 100 | XII | 200 | 1.30 | 0.64 | 550 |
| B | SE18 | 100 | — | — | 1.10 | 0.68 | 550 |
| C | SE18 | 50 | — | — | 0.67 | 0.65 | 550 |

As can be seen from samples A according to the invention in Tables 3 to 5, the gamma differentiation on exposure behind the yellow filter (column 6) is considerably higher than in the case of the unstabilized comparison samples B and C.

EXAMPLE 5

A silver chloride emulsion containing 70 mol-% chloride and 30 mol-% bromide and having an average grain size of 0.3μ is prepared and chemically ripened in the same way as described in Example 1.

The emulsion is then divided into two equal parts as described in Example 4. The first partial emulsion is sensitized with 75 μmol per mol Ag of the sensitizing dye SE 6. The second partial emulsion is sensitized with a blue sensitizer BS as shown in Table 6 and stabilized with 240 mg of stabilizer III. After mixing of the partial emulsions, the resulting emulsion is cast onto PE paper supports. The layers are subjected as in Example 4 to sensitometric exposure behind yellow and magenta filters.

The results are shown in Table 6. In Table 6, column shows the blue sensitizer BS, column 2 shows the quantity of the blue sensitizer in μmol per mol Ag of the second partial emulsion column 3 shows log ER behind a Yw filter, column 4 shows log ER behind an Mg filter column 5 shows the increase in sensitivity behind the Mg filter in relative log units by comparison with a BS-free sample, column 6 and 7 show the spectral sensitization maxima in nm

TABLE 6

| | Emulsion: 70% $Cl^{\ominus}$, 30% $Br^{\ominus}$, 0.30μ | | | | | |
|---|---|---|---|---|---|---|
| 1 | 2 | 3 | 4 | 5 | 6 | 7 |
| BS8 | 20 | 1.07 | 0.50 | 0.35 | 467 | 545 |
| BS4 | 40 | 1.01 | 0.53 | 0.40 | 470 | 545 |
| BS6 | 40 | 1.20 | 0.51 | 0.25 | 455 | 545 |
| BS3 | 40 | 1.16 | 0.55 | 0.15 | 445 | 545 |

TABLE 6-continued

| | Emulsion: 70% $Cl^{\ominus}$, 30% $Br^{\ominus}$, 0.30μ | | | | | |
|---|---|---|---|---|---|---|
| 1 | 2 | 3 | 4 | 5 | 6 | 7 |
| BS7 | 40 | 1.10 | 0.51 | 0.30 | 470 | 545 |
| — | — | 1.18 | 0.52 | — | — | 545 |

As can be seen from Table 6, the blue sensitivity (column 5) may be consierably increased by addition of the blue sensitizers without any loss of the gamma differentiation according to the invention.

We claim:

1. A gradation-variable black-and-white paper comprising a silver halide emulsion layer of a mixture of at least two photosensitive silver halide emulsions, of which one has its absorption maximum in the range from 480 to 580 nm while the other has its absorption maximum below 480 nm, characterized in that only the emulsion which has its absorption maximum below 480 nm contains a compound corresponding to the following formula

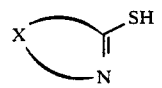

in which

X represents the remaining members of an optionally benzo- or naphtho-condensed heterocycle optionally containing further substituents.

2. A gradation-variable black-and-white paper as claimed in claim 1, characterized in that the emulsion which has its absorption maximum below 480 nm contains a compound corresponding to the following formula

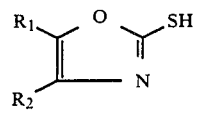

in which $R_1$ and $R_2$ are the remaining members of a benzo or naphtho radical substituted by at least one sulfo group and optionally containing further substituents.

3. A gradation-variable black-and-white paper as claimed in claim 2, in which $R_1$ and $R_2$ represent the remaining members of a benzo or naphtho radical substituted by one or two sulfo groups and optionally substituted by $C_1$–$C_4$ alkyl or halogen.

4. A gradation-variable black-and-white paper as claimed in claim 1, characterized in that the emulsion contains silver halides of 20 to 80 mol-% chloride, 20 to 80 mol-% bromide and 0 to 4 mol-% iodide.

5. A gradation-variable black-and-white paper as claimed in claim 1, characterized in that the average grain size of the silver halide emulsions is from 0.2 to 0.6 μm.

* * * * *